United States Patent [19]

Costello

[11] 4,351,299

[45] Sep. 28, 1982

[54] FUEL INJECTION SYSTEM

[75] Inventor: Christopher Costello, London, England

[73] Assignee: Lucas Industries Limited, Birmingham, England

[21] Appl. No.: 141,970

[22] Filed: Apr. 21, 1980

[30] Foreign Application Priority Data

Feb. 19, 1980 [GB] United Kingdom ..... 8005553

[51] Int. Cl.[3] ..... F02D 35/00; F02P 5/04; F02D 5/00; F02M 51/00

[52] U.S. Cl. ..... 123/472; 123/434; 123/478; 361/152; 361/159

[58] Field of Search ..... 123/478, 488, 490, 494, 123/434, 445, 472; 361/152, 159

[56] References Cited

U.S. PATENT DOCUMENTS

| | | | |
|---|---|---|---|
| 3,623,460 | 11/1971 | Komaroff | 123/472 |
| 3,654,905 | 4/1972 | Mennesson | 123/478 |
| 3,990,412 | 11/1976 | Zechnall et al. | 123/478 |
| 4,082,066 | 4/1978 | Long | 123/478 |
| 4,148,283 | 4/1979 | Harada et al. | 123/494 |
| 4,197,996 | 4/1980 | Giardini | 123/472 |
| 4,221,194 | 9/1980 | Wright | 123/478 |
| 4,237,830 | 12/1980 | Stivender | 123/434 |
| 4,258,674 | 3/1981 | Wolff | 123/472 |

*Primary Examiner*—Raymond A. Nelli

[57] ABSTRACT

A fuel injection system includes a pump including a pump plunger and electromagnetic means for actuating the plunger against the action of a spring. The electromagnetic means includes a winding which is energized to cause delivery of fuel. First electronic means is provided to cause energization of the winding when delivery of fuel is required and second electronic means operable to cause de-energization of the winding. The second electronic means includes a comparator which receives a required fuel signal and a signal from a transducer which provides a signal representative of the plunger position. When the predetermined movement of the plunger has taken place the winding is de-energized to allow the plunger to return under the action of the spring.

4 Claims, 3 Drawing Figures

FUEL INJECTION SYSTEM

This invention relates to a fuel injection system for supplying fuel to an internal combustion engine, the system being of the kind comprising a pumping plunger slidable in a bore, an outlet from one end of the bore, a valve controlled fuel inlet to said one end of the bore, electromagnetic means which is supplied with electric current to cause movement of the plunger towards said one end of the bore, resilient means operable when the supply of electric current is halted to effect movement of the plunger away from said one end of the bore and transducer means for providing a signal indicative of the position of the plunger within the bore.

When such a fuel system is utilised to supply fuel to an engine it is necessary to be able to vary the stroke of the plunger in order to be able to vary the amount of fuel supplied to the engine. This can be achieved by halting the return movement of the plunger as it moves away from said one end of the bore under the action of the resilient means. If the position at which the plunger is halted during its return movement is varied, the quantity of fuel supplied is also varied assuming of course that the plunger always moves to the one end of the bore when fuel is being delivered through the outlet. Halting the movement of the plunger during its return movement is possible by applying just sufficient force to the plunger to balance the force exerted by the resilient means and any pressure of fuel in the bore if fuel is supplied to the bore under pressure. In the case where the electromagnetic means acts directly on the plunger, the current flow in the electromagnetic means must be carefully adjusted to ensure that the movement of the plunger is arrested at the required position. The system is therefore complex and in addition the fact that current must be supplied to the electromagnetic means at times other than when injection of fuel is taking place means that extra power is required to operate the system and this extra power leads to the generation of heat.

The object of the present invention is to provide a fuel system of the kind specified in a simple and convenient form.

According to the invention a fuel system of the kind specified comprises first electronic means operable to effect energisation of said electromagnetic means, second electronic means operable to effect de-energisation of said electromagnetic means, third electronic means for supplying a required fuel signal to said second electronic means, said second electronic means also receiving the signal from said transducer whereby the supply of electric current to the electromagnetic means is cut off after a predetermined movement of the plunger thereby allowing the plunger to return to its initial position under the action of the resilient means.

An example of a fuel system according to the invention will now be described with reference to the accompanying drawings in which.

Figure 1:
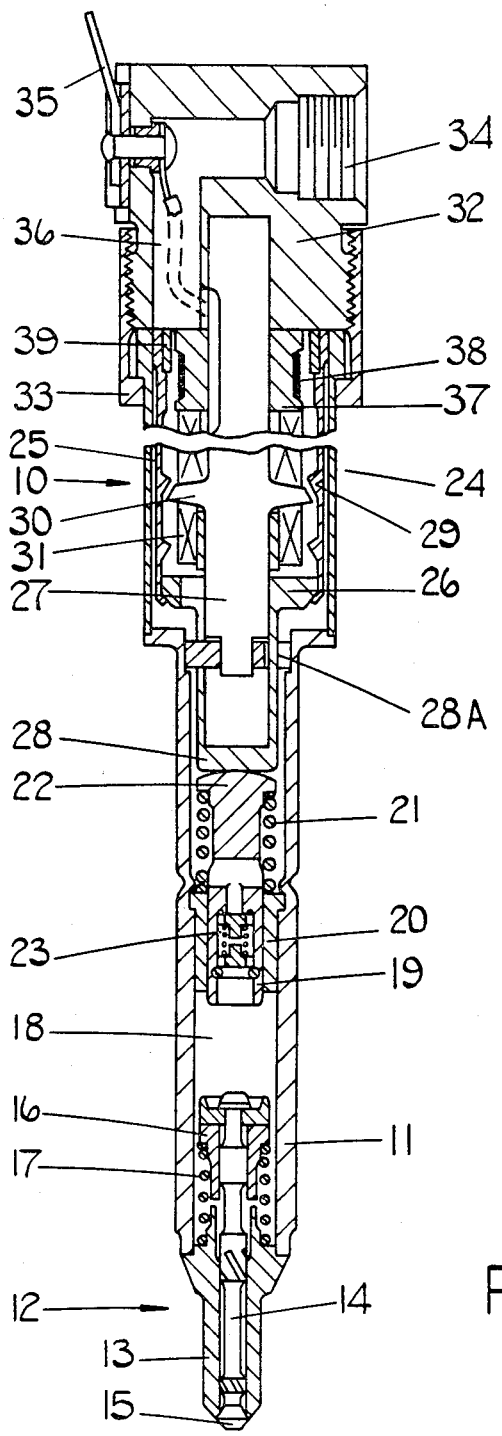
FIG. 1 is a sectional side elevation of one form of fuel pump.

Referring to FIG. 1 of the drawings a pump/injector generally indicated at 10, comprises a hollow cylindrical stepped body 11, the narrower end of which mounts an injection valve assembly 12. This comprises a nozzle body 13 which is stepped at one end for location within the body. The bodies 11 and 13 are secured in the particular example, by electron beam welding.

A bore is formed in the body 13 and located and slidable with the bore, is a valve member 14 having a head 15 engageable with a seating defined at the outer end of the body 13. The valve member 14 is fluted or otherwise recessed to enable fuel when the head 15 is lifted from the seat, to flow through the bore into the associated combustion chamber of the associated engine. The valve member extends from the end of the bore remote from the seating and it carries an abutment 16 with which engages one end of a coiled compression spring 17. The other end of the spring 17 engages the body 13. The head is biassed into engagement with the seating and is lifted therefrom by the pressure of fuel developed in a pumping chamber 18 within the narrower portion of the body 11.

The volume of the pumping chamber is varied by means of a pumping plunger 19 which is slidable within a bore defined within a flanged sleeve 20 secured against a step defined in the internal surface of the narrower portion of the body 11. The plunger 19 is resiliently loaded in the outward direction i.e. in a direction to increase the volume of the pumping chamber 18, by means of a coiled compression spring 21 which extends between the sleeve 20 and a head 22 defined in the plunger. The sleeve is retained in position by suitable deformation of the body 11.

The plunger 19 is provided with passages incorporating a non-return valve 23 and by way of this valve fuel can flow into the pumping chamber as the plunger is moved outwardly by the spring 21. Alternatively the plunger during its outward movement can uncover a port in the wall of the sleeve to allow fuel to flow into the pumping chamber.

For effecting inward movement of the plunger 19 the there is provided an electromagnetic device generally indicated at 24 and this is housed within the wider portion of the body 11. The electromagnetic device comprises a hollow cylindrical armature 25 which is positioned adjacent the inner surface of the wider portion of the body 11 and is formed from magnetisable material. The end portion of the armature which is nearer to the narrower portion of the body, is mounted on a member 26 which is slidably carried on a central support 27. The member 26 also has a hollow slotted extension 28 which is positioned for engagement with the head 22 of the plunger. The support member 27 at its lower end also mounts a support **28*a* which locates the support member in the body 11**.

The interior surface of the armature is provided with a two start helical thread which defines a pair of helical ribs 29. Moreover, the aforesaid central support member forms a yoke and it is also provided with a pair of helical ribs 30. The presented surfaces of the ribs 29 and 30 are inclined to the longitudinal axis of the pump/injector and are spaced from each other in the de-energised condition (as shown) of the electromagnetic device. The central support member carries in the two helical troughs defined between the ribs 30, an electrical winding 31 which conveniently is formed by winding a length of wire along one trough from one end of the support member and returning towards the one end of the support member along the other trough. The winding can have a number of turns as required and when the winding is energised the two ribs 30 will assume opposite magnetic polarity and flux paths will be set up which include the air gaps between the ribs 29 and 30. As a result the armature will be moved by the magnetic forces in a direction to reduce the reluctance of the air gap and in so doing will effect inward movement of the plunger 19 causing an increase in the pressure of the fuel in the pumping chamber. When the pressure rise is sufficient to lift the head 15 of the valve member from its seat, fuel is delivered to the associated combustion chamber. When the winding is de-energised the plunger and armature are returned to the position shown at a rate which is determined by the rate at which fuel can flow into the chamber 18 under the action of the spring 21.

The central support member 27 is carried by an end closure 32 which is retained relative to the body 11 by means of a retaining nut 33. The end closure defines a fuel inlet 34 which communicates with the interior of the wider portion of the body through a passage 36. Also provided is an electrical terminal 35 which is connected to one end of the winding 31, the other end being connected to the end closure.

A transducer is incorporated into the pump/injector to provide an indication of the position of the armature and the transducer comprises a core member 37 which is located about the support member 27 and is provided with a circumferential groove in which is located a winding 38. The armature mounts a ring 39 and which is formed from electrically conductive material. As the armature moves the inductance of the winding 38 varies.

Figure 3:
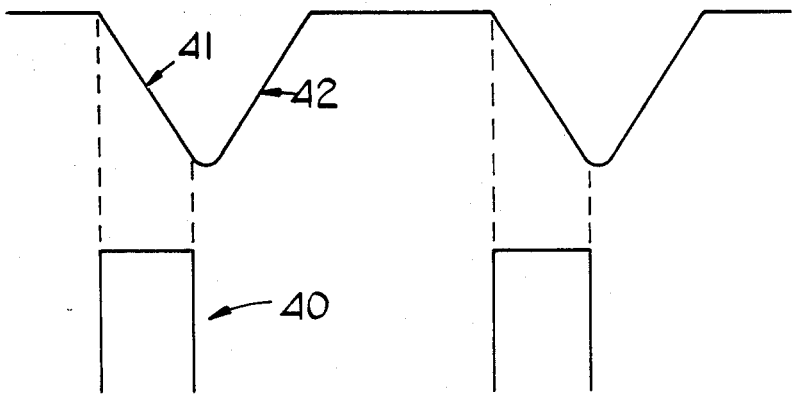
FIG. 3 is a diagram illustrating the relationship between fuel delivery and the supply of current to part of the pump.

Turning now to FIG. 3 when a current pulse indicated generally at 40 is supplied to the winding 31, the plunger will start to move downwardly against the action of the spring. This movement is indicated by the portion 41 of the upper curve. When the supply of current ceases, there will be a slight further movement of the plunger due to its inertia and also due to the fact that the flux in the magnetic circuit does not collapse immediately. Shortly afterwards however the plunger will cease to move against the action of the spring and will then move in the reverse direction as indicated by the portion 42 of the curve, under the action of the spring 21. Thus by varying the length in terms of time, of the current pulse so the amount of fuel supplied to the engine can be varied.

It is necessary when injecting fuel to an engine to ensure that the delivery of fuel takes place at the correct time and it is therefore necessary to provide transducers which can provide a signal indicative of the engine position. It is also necessary to take into account various working conditions of the engine and also to ensure that the speed of the engine is kept within prescribed limits.

Figure 2:
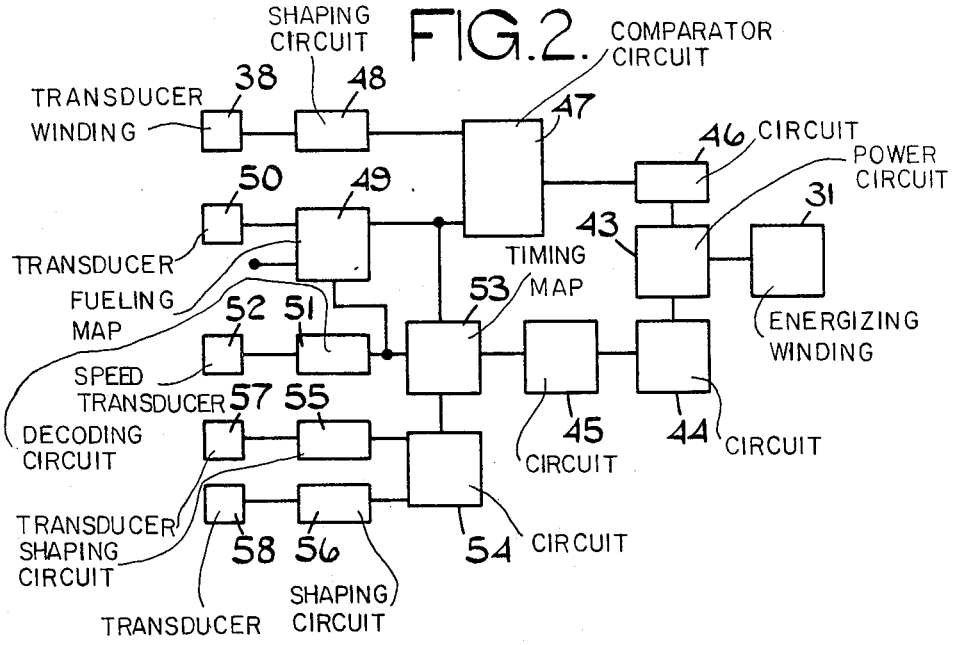
FIG. 2 is a block diagram of the control system.

Turning now to FIG. 2 the winding 31 is indicated as also is the transducer winding 38.

The winding 31 receives it operating current from an output or power circuit 43 and this is controlled by first and second electronic means. The first electronic means includes a switching circuit 44 which can supply to the circuit 43 a signal to turn on the output circuit when it is required to supply current to the winding 31. The switching circuit 44 receives a signal from a circuit 45 which acts as an interface between the switching circuit and a timing map 53 to be described.

The second electronic means comprises a switching circuit 46 which can supply a signal to the power circuit 43 when it is required to halt the flow of current in the winding 31. The switching circuit 46 receives the output from a comparator circuit 47. One input of the comparator circuit is a signal representing the position of the plunger, this being obtained from the transducer winding 38 through a shaping circuit 48. The other input to the comparator 47 is derived from a third electronic means 49 which may for example comprise a "fueling map". This includes a Read Only Memory (ROM) in which is stored information regarding allowed fuel quantity for various engine speeds and various input demands. Alternatively the circuit 49 may be a governor circuit. The output of the circuit 49 is a required fuel signal. One input to the circuit 49 is a demanded fuel signal which is obtained from a transducer 50 which may be associated with the control pedal of the vehicle driven by the engine. Depression of the pedal to increase the supply of fuel to the engine will effect an increase in the signal supplied by the circuit 49. The circuit 49 also receives a signal indicative of the rotational speed of the engine from a decoding circuit 51 which is supplied with a signal from a speed transducer 52. The circuit 49 may also receive further signals indicative of various operating parameters of the engine for example the pressure of air supplied to the inlet manifold or the temperature of the engine. In the case where the circuit 49 is a fuel map, the output of the circuit will be a signal having a value appropriate to the demanded fuel and the engine speed and any other operating perameter. In the case where the circuit 49 is a governor, the signal provided by the circuit 49 will be generated therein. The circuit 49 ensures that for a given speed, the maximum amount of fuel which can be supplied to the engine is not exceeded and as the engine speed approaches its maximum allowed value, the signal will decrease to reduce or possibly cut off the supply of fuel to the associated engine.

A fourth electronic means is provided to determine the instant of fuel delivery to the engine. The fourth electronic means includes a so-called "timing map" indicated at 53 and this receives the engine speed signal from the decoder 51. The circuit 53 may comprise a ROM in which has been stored information representing the required timing of delivery of fuel to the engine for various engine speeds. The timing map is also provided with a signal from the circuit 49 since it is desirable that the timing of delivery of fuel should vary in accordance with the amount of fuel being supplied to the engine this representing the load on the associated engine.

The circuit 54 may comprise a simple AND gate and it provides an engine position signal which is applied to the "timing map" 53 so that the latter can effect energization of the winding 31 at the appropriate instant. The circuit 54 is supplied by way of shaping circuits 55,56 with signals from transducers 57, 58 the signals representing the engine crankshaft position and camshaft position respectively.

In operation, when the timing map provides an output signal indicative of the fact that injection of fuel should start, the circuit 44 provides a control signal to the circuit 43 to supply current to the winding 31. The current in the winding 31 will increase and at some point the plunger will start to move thereby delivering fuel through the outlet. The movement of the plunger is indicated to the comparator 47 by means of the transducer and when the predetermined movement of the plunger has taken place, the circuit 46 provides a control signal which halts the supply of current to the winding 31. As previously mentioned, the plunger will continue moving under the effect of inertia and also the decaying magnetic flux. The extra quantity of fuel which is delivered during the continued movement can be taken care of in the circuit 49. As soon as it is halted however it starts to move in the opposite direction under the action of the spring and fuel is drawn into the pumping chamber. The plunger returns to its initial position.

It will be appreciated that delivery of fuel does not take place as soon as electric current is applied to the winding 31 since it is necessary for the magnetic flux to build up and for the fuel pressure in the pumping chamber to rise to a value such that the valve head of the injection nozzle is lifted from its seating. This delay whilst not shown in FIG. 3, has to be taken into account and this can be effected in the circuit 53.

I claim:

1. A fuel injection system for supplying fuel to an internal combustion engine, the system being of the kind comprising a pumping plunger slidable in a bore, an outlet from one end of the bore, a valve controlled fuel inlet to said one end of the bore, electromagnetic means which is supplied with electric current to cause movement of the plunger towards said one end of the bore, resilient means operable when the supply of electric current is halted to effect movement of the plunger away from said one end of the bore, transducer means for providing a signal indicative of the position of the plunger within the bore, first electronic means operable to effect energisation of said electromagnetic means, second electronic means operable to effect de-energisation of said electromagnetic means, third electronic means for supplying a required fuel signal to said second electronic means, said second electronic means also receiving the signal from said transducer whereby the supply of electric current to the electromagnetic means is cut off after a predetermined movement of the plunger thereby allowing the plunger to return to its initial position under the action of the resilient means.

2. A system according to claim 1 including fourth electronic means for supplying a signal to said first electromagnetic means, said fourth electronic means including means for providing a signal indicative of the position of the rotary parts of the associated engine and said fourth electronic means receiving said required fuel signal and a signal indicative of the engine speed whereby fuel is delivered to the associated engine at a time which is varied in accordance with the speed of and the amount of fuel supplied to the engine.

3. A system according to claim 2 in which said third electronic means receives a signal indicative of the engine speed.

4. A system according to any one of the preceding claims 1 to 3 in which said second electronic means includes a comparator which compares the signal from said transducer and the signal from said third electronic means.

* * * * *